US006034658A

United States Patent [19]

Grand-Clement et al.

[11] Patent Number: 6,034,658

[45] Date of Patent: Mar. 7, 2000

[54] DOUBLE GRID MICROTIP COLOR SCREEN

[75] Inventors: Jean-Luc Grand-Clement, Rousset; Bernard Bancal, Luynes, both of France

[73] Assignee: Pixtech SA, Rousset, France

[21] Appl. No.: 08/851,732

[22] Filed: May 6, 1997

[30] Foreign Application Priority Data

May 6, 1996 [FR] France ..... 96 05934

[51] Int. Cl.[7] ..... G09G 3/32

[52] U.S. Cl. ..... 345/74; 345/75

[58] Field of Search ..... 345/74, 75; 313/366, 313/309, 422, 495; 349/61; 328/64

[56] References Cited

U.S. PATENT DOCUMENTS

| | | | |
|---|---|---|---|
| 5,150,067 | 9/1992 | McMillan | 328/64 |
| 5,160,871 | 11/1992 | Tomii et al. | 315/366 |
| 5,243,252 | 9/1993 | Kaneko et al. | 313/309 |
| 5,604,394 | 2/1997 | Saito et al. | 313/422 |
| 5,650,690 | 7/1997 | Haven | 313/422 |
| 5,760,858 | 6/1998 | Hodson et al. | 349/61 |
| 5,764,204 | 6/1998 | Bancal | 345/74 |
| 5,798,604 | 8/1998 | Duboc, Jr. et al. | 313/495 |

FOREIGN PATENT DOCUMENTS 0660368 6/1995 European Pat. Off. .

OTHER PUBLICATIONS

Patent Abstract of Japan, vol. 012, No. 412 (E–676), Oct. 31, 1988 & JP 63 150837 A (Canon Inc), Jun. 23, 1988.

Patent Abstract of Japan, vol. 018, No. 434 (E–1592), Aug. 12, 1994 & JP 06 139918 A (Shimadzu Corp.), May 20, 1994.

European Search Report, dated Jan. 21, 1997.

*Primary Examiner*—Matthew Luu
*Assistant Examiner*—Jeff Piziali
*Attorney, Agent, or Firm*—Arthur L. Plevy; Buchanan Ingersoll PC

[57] ABSTRACT

A flat color microtip screen including a cathode divided into columns addressable independently; a first pixel selection grid divided into rows; a second color selection grid including a plurality of groups of slots extending along in columns, each group of three slots corresponding to a cathode column, slots of the same row of each group being connected to a same terminal; an anode including groups of three parallel bands of luminescent material, each band corresponding to one of the slots, all bands being at the same potential.

10 Claims, 2 Drawing Sheets

DOUBLE GRID MICROTIP COLOR SCREEN

BACKGROUND OF THE INVENTION

1. Field of the Invention

The present invention relates to flat microtip display screens.

2. Discussion of the Related Art

An example of such a screen and of its addressing mode is described in U.S. Pat. No. 5,225,820 issued to Jean-Frédéric Clerc.

In this screen, the cathode is comprised of a very large number of microtips connected in columns, each of which can be addressed individually. The ends of these microtips emerge in openings of an insulating grid. This grid is divided into rows which are orthogonal to the columns, and addressable individually.

An anode is placed facing the cathode/grid assembly and is separated therefrom by an empty space. On this anode are arranged groups of bands of luminescent or phosphor elements of three different colors, for example, red, green, and blue. The bands are arranged in columns parallel to the cathode columns. A group of three red, green, and blue bands has substantially the width of a cathode column. All bands of phosphors of a same color are interconnected so that it is possible to selectively address all the red bands, all the green bands or all the blue bands.

An addressing cycle of a complete image (a frame) includes the step of addressing all the anode bands of same nature, for example, all the red bands and, while these red bands are under high voltage, sequentially addressing each of the grid rows. For each biasing of a grid row, all cathode columns are addressed at potentials selected to obtain a desired luminescence of each of the red pixels. The operation is then repeated for the green bands and the blue bands and a line-by-line and color-by-color (sub-frame by sub-frame) addressing of a complete frame is thus obtained.

This addressing mode requires a switching of the potentials on the anodes. Now, the anode potential generally is a high potential so that the energy of the electrons sent by the cathodes causes a sufficient lighting of the phosphors. In the above-mentioned U.S. patent, anode potentials of around 150 volts are indicated. In practice, to obtain a sufficient lighting with conventional phosphors, potentials of around 600 to 1000 volts are conventionally used and it is desired to be able to use still higher potentials. Now, the difficulty to carry out a potential switching of an electrode increases with the potential. Thus, the need to switch high anode potentials constitutes a drawback.

SUMMARY OF THE INVENTION

An object of the present invention is to provide a new flat color microtip screen structure and a new mode of addressing this screen such that the switching of high potentials is avoided.

To achieve this object, the present invention provides a flat color microtip screen including a cathode with microtips divided into columns addressable independently; a first pixel selection grid divided into rows addressable independently; a second color selection grid including a plurality of groups of slots extending along the column direction, each group of three slots corresponding to a cathode column, slots of the same row of each group being connected to a same terminal; and an anode including groups of three parallel bands in a column of luminescent material of three selected colors, a group of three bands corresponding to a cathode column, each band corresponding to one of the slots, all bands of luminescent material being brought to a same potential in operation.

According to an embodiment of the present invention, the second grid is formed by cutting out a thin metal sheet to form therein the slots and rigidifying spacers, one band out of three being defined by the facing edges of the cut out metal sheet, the two other bands out of three being formed by the facing edges of conductive layers deposited on an insulating layer itself formed on the sheet.

The control process of the above screen includes the steps of bringing the anodes to a high anode potential, bringing the slot metallizations of the second grid corresponding to a first color to an enabling potential and the other metallizations corresponding to the two other colors to a blocking potential, sequentially bringing all rows of the first grid to an addressing potential, upon addressing of each row of the first grid, biasing the cathode columns at a potential selected to obtain a desired luminescence of the pixels of the selected color of the row, repeating the operation for the two other colors, and repeating all operations for the following frames.

An advantage of the present invention is that it leads to only switching the potentials of a cathode, of a first grid and of a second grid, which are all potentials with low values with respect to that of the anode. As a result, the switching times can be shorter and the switching components can be simpler.

The foregoing objects, features and advantages of the present invention, will be discussed in detail in the following non-limiting description of specific embodiments of the present invention, in relation with the accompanying drawings.

DETAILED DESCRIPTION

Figure 1:
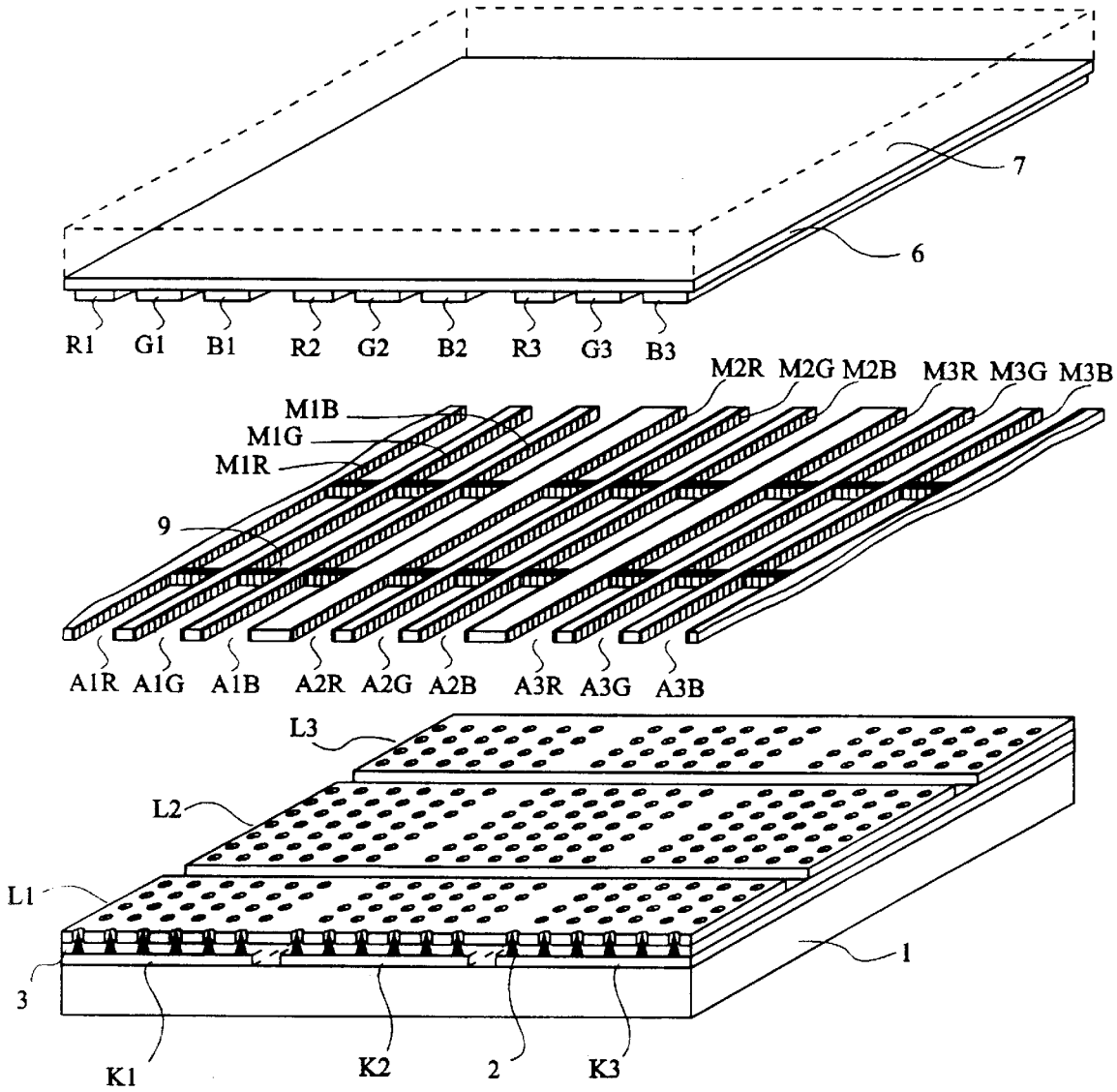
FIG. 1 is a simplified exploded perspective view of a portion of a flat microtip screen according to an embodiment of the present invention.

As shown in FIG. 1, the cathode and lower grid assembly of a screen according to the present invention is identical to conventional implementations such as that described in the above-mentioned U.S. patent. This assembly is implemented on an insulating substrate 1, for example, a glass plate. Microtips 2 are formed on columns of cathode conductors K1, K2, K3 . . . . Rows of grid conductors L1, L2, L3 . . . are formed on an insulating layer 3 covering the cathode conductors. The ends of the microtips emerge substantially at the level of the upper opening parts of the grid. Of course, this representation is very simplified and several known alternative implementations may be used, especially means for forming a resistance between each microtip and the associated cathode conductor.

The anode is similar to conventional anodes. Facing each cathode column K, three bands of luminescent material R, G, B, also extending in columns are arranged. A difference with respect to the state of the art is that these several bands, instead of being interconnected by bands of same nature (the red bands, the green bands, the blue bands), are all brought to the same anode potential as the screen operates. For this purpose, all phosphor bands can for example be formed on a same conductive layer 6 formed on a substrate 7. Generally, layer 6 and substrate 7 will be made of transparent materials, for example, respectively, a conductive indium and tin oxide (ITO) layer and a glass plate.

The screen according to the present invention includes a second grid provided with slots extending in the column direction, the crosswise dimensions of which substantially correspond to those of the anode phosphor bands, and respectively referred to by references A1R, A1G, A1B; A2R, A2G, A2B; A3R, A3G, A3B . . . Thus, each slot corresponds to a phosphor band and the expressions "red slot", "green slot", "blue slot" will be used hereafter, for simplicity. In the simplified embodiment of FIG. 1, it has been assumed that the second grid was formed in an insulating material and that the internal edges of each of the slots were coated with a lateral metallization M1R, M1G, M1B; M2R, M2G, M2B; M3R, M3G, M3B . . . The lateral metallizations corresponding to slots associated with a same color are connected to a same terminal (not shown), that is, metallizations M1R, M2R, M3R . . . are connected to a same terminal, as well as metallizations M1G, M2G, M3G . . . and M1B, M2B, M3B . . .

In FIG. 1, spacers 9 have also been shown for the second grid. These spacers, which are used to ensure the mechanical support of the grid, have no functional role and are not necessarily arranged in the regular manner shown.

Although not shown in the drawing, insulating and spacing means are provided between the second grid and the upper surface of the first grid, and between the second grid and the lower surface of the anode. Many embodiments can be devised by those skilled in the art to implement these insulating and spacing means.

The addressing mode of the device will be substantially the same as the one described in the above-mentioned U.S. patent except that, instead of performing a switching of bands of anode phosphors, a switching of the lateral slot metallizations of the second grid is performed.

The advantage of the present invention appears from an analysis of typical values of potentials to be applied to the several screen electrodes.

Assume that it is desired to address the red pixels corresponding to row L2 of the first grid. This row L2 will be set at a potential of around 80 volts, the other rows L1, L3 . . . being grounded. Columns K1, K2, K3 . . . will be at potentials of around 0 to 30 volts according to the desired brightness of the pixels considered. The metallizations MR (M1R, M2R, M3R . . . ) of the red slots of the second grid will be set at a potential of +10 V with respect to ground, to let through the electrons emitted by the underlying tips towards the red phosphors. The metallizations MG and MB of the green and blue slots will be set at a potential of −10 V with respect to ground, to block the electrons which would normally be directed therethrough towards the green and blue phosphors. It should be noted that this second grid not only functions as an obturator, but also as a focusing means. It is thus ensured that, when the "red slots" of the second grid are enabled, only red phosphors will be bombarded. This focusing effect will be optimized by a setting of the color selection potential applied to the slots of the second grid.

To switch from one color to another, it is thus enough to switch the potentials applied to the second grid between two relatively close potential values (+ and −10 V) with respect to the grid potential. For this purpose, it is enough to have relatively simple and low cost switching components, and, besides, the switching rate can be high.

Another advantage of the present invention is that, since the anode no longer needs to be switched, it can be set at a very high potential, for example, several thousands of volts, so that the energy of the electrons will be much higher and will produce a better lighting of the phosphors. Further, it will then be possible to coat the phosphors on their internal surface side with a thin conductive layer, for example, a thin aluminum layer which, in a known way, provides many advantages, especially avoiding parasitic lighting phenomena.

The several above numerical values have been indicated as an example only and those skilled in the art will be able to adapt the indicated values according to the particular device used and to the desired effect.

Apart from the above-mentioned advantages, it should be noted that a further advantage of the present invention is that it enables the use of cathode and first grid systems identical to those already fabricated in the prior art and thus only requires a modification (a simplification) of the anode structure and the implementation of an additional grid.

Of course, the present invention is likely to have various alterations, modifications, and improvements which will readily occur to those skilled in the art, especially as concerns the implementation of the insulating and spacing structures to be arranged between the additional grid and the anode plates on the one hand, and the cathode/grid plates on the other hand. These insulating and spacing systems can be comprised of spacing beads or perforated spacing plates. In particular, a perforated insulating spacing plate will preferably be used between the second grid and the anode.

Figure 2:
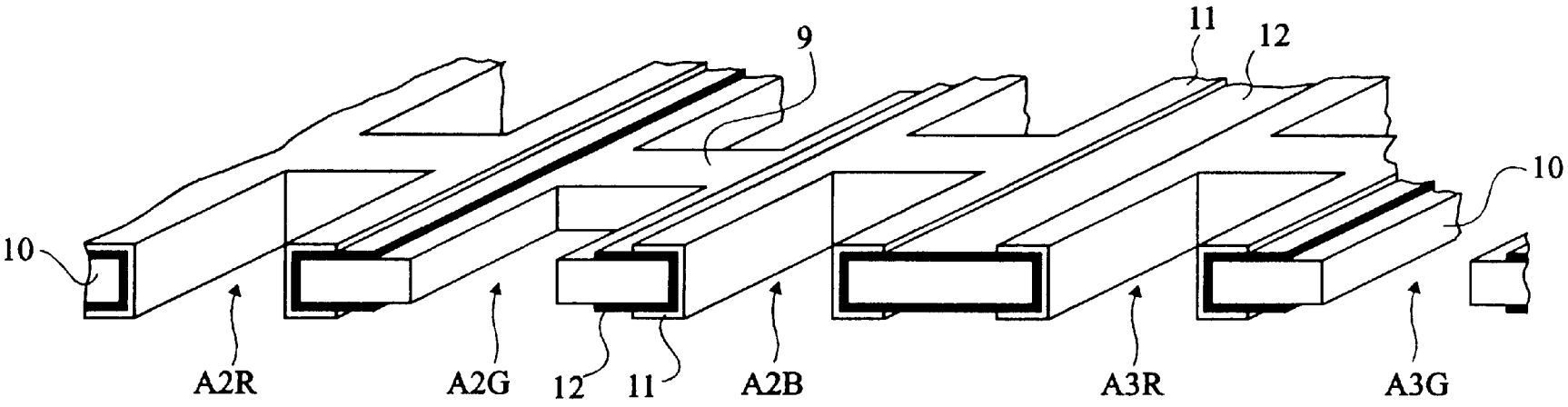
FIG. 2 is a simplified partial perspective view of a second grid according to an embodiment of the present invention.

FIG. 2 shows an example of embodiment according to the present invention of a second grid. This grid is made from a metal sheet 10 stamped to define slots AR, AG, AB (only portions of slots A2R, A2G, A2B, A3R, A3G, are shown) and rigidifying spacers 9.

In the embodiment shown, the slots AG (A2G, A3G) are directly defined by the facing edges of metal sheet 10. Conversely, the slots AR and AB are defined by the facing edges of conductive layers 11 formed on an insulating layer 12 deposited on the metal sheet. The deposition and definition of these insulating and conductive layers can be implemented conventionally. It should be clear that all metallizations of the AG slots are at the same potential (that of the metal sheet). Similarly, the metallizations of each of slots AB and the metallizations of each of slots AR will be brought to a same potential.

The fact that one of the three electrodes of the second grid is made of the material of a metal sheet makes the interconnection of the two other groups of metallizations of this grid, which may for example be interconnected by metallized and insulated bands arranged at the opposite ends of the slot metallizations, particularly simple.

Another advantage of implementing the second grid from a stamped conductive plate is that such a conductive plate can be very thin while having a good mechanical hold. Its thickness may for example be around 1 to 5 tenths of a millimeter and the metal which forms it will for example be aluminum, copper, stainless steel, nickel, or an aluminum alloy.

As an example of numerical values, a grid according to the present invention can be used with a screen having a diagonal dimension of around one meter, the dimensions of a pixel being of around one millimeter. The pitch of the grid will then be around 0.15 mm, the distance between groups of three slots being around 0.25mm.

What is claimed is:

1. A flat color microtip screen comprising:

a cathode including microtips (2) divided into independently addressable cathode columns (K1, K2, K3 . . . );

a first pixel selection grid divided into independently addressable rows (L1, L2, L3 . . . );

a second color selection grid including a plurality of groups of slots extending along a same direction as said cathode columns, each group of three slots (AiR, AiG, AiB) corresponding to one of said cathode columns, slots of a same group corresponding to a same color being connected to a same terminal; and an anode including groups of three parallel bands in a column of luminescent material of three selected colors (RGB), each group of three bands corresponding to a cathode column, each band corresponding to one of the slots, all bands of luminescent material being adapted to be substantially simultaneously brought to a same potential in operation.

2. A screen according to claim 1, wherein the second grid is formed by cutting out a thin metal sheet (10) to form therein the slots and at least one rigidifying spacer (9), one band out of three being defined by the facing edges of the cut out metal sheet, the two other bands out of three being formed by facing edges of conductive layers deposited on an insulating layer itself formed on the sheet.

3. A control process of a screen according to claim 1, including the following steps:

bringing the anodes to a high anode potential, bringing the slot metallizations of the second grid corresponding to a first color to an enabling potential and the other metallizations corresponding to the two other colors to a blocking potential, sequentially bringing all rows of the first grid to an addressing potential, upon addressing of each row of the first grid, biasing the cathode columns at a potential selected to obtain a desired luminescence of the pixels of the selected color of the row, repeating the operation for the two other colors, and repeating all operations for the following frames.

4. A method for operating a flat, color display screen comprising the steps of:

substantially simultaneously bringing at least a first plurality of anode strips associated with a first color and a second plurality of anode strips associated with a second color to a first anode potential;

bringing slot metallizations of a first grid corresponding to said first plurality of anode strips to an enabling potential and metallizations of said first grid corresponding to said second plurality of anode strips to a blocking potential;

sequentially bringing all rows of a second grid associated with a cathode to an addressing potential; and, biasing cathode columns at a potential selected to obtain a desired luminescence of the pixels of the first color of the row.

5. The method of claim 4, further comprising the step of bringing a third plurality of anode strips associated with a third color to said first anode potential substantially simultaneously with said first and second pluralities of anode strips.

6. The method of claim 5, further comprising the step of bringing slot metallizations of said first grid corresponding to said third plurality of anode strips to a blocking potential.

7. The method of claim 4, further comprising the step of substantially simultaneously bringing slot metallizations of said first grid corresponding to said second plurality of anode strips to said enabling potential and metallizations of said first grid corresponding to said first plurality of anode strips to said blocking potential while maintaining said first and second pluralities of anode strips at said first anode potential.

8. A method for operating a flat, color display screen comprising the steps of:

substantially simultaneously bringing at least a first plurality of anode strips associated with a first color and a second plurality of anode strips associated with a second color to a first anode potential;

sequentially bringing all rows of a second grid associated with a cathode to an addressing potential;

biasing cathode columns at a potential selected to obtain a desired luminescence of the pixels of the first color of the row; and, in a first mode, bringing slot metallizations of a first grid corresponding to said first plurality of anode strips to an enabling potential and metallizations of said first grid corresponding to said second plurality of anode strips to a blocking potential; and, in a second mode bringing slot metallizations of said first grid corresponding to said second plurality of anode strips to said enabling potential and metallizations of said first grid corresponding to said first plurality of anode strips to said blocking potential.

9. The method of claim 8, further comprising the step of bringing at least a third plurality of anode strips associated with a third color to said first anode potential substantially simultaneously with said first and second pluralities of anode strips.

10. The method of claim 9, further comprising the steps of:

in said first and second modes, bringing slot metallizations of said first grid corresponding to said third plurality of anode strips to said blocking potential; and, in a third mode, bringing slot metallizations of said first grid corresponding to said third plurality of anode strips to said enabling potential and metallizations of said first grid corresponding to said first and second pluralities of anode strips to said blocking potential.

* * * * *